US006966817B2

(12) United States Patent
Tang et al.

(10) Patent No.: US 6,966,817 B2
(45) Date of Patent: Nov. 22, 2005

(54) WAFER GRINDER

(75) Inventors: Kuo-Yu Tang, Hsin Chu (TW); Jung-Hong Huang, Ta Li (TW); Lei-Yi Chen, Chu Tung Jen (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 10/775,134

(22) Filed: Feb. 11, 2004

(65) Prior Publication Data

US 2005/0176347 A1 Aug. 11, 2005

(51) Int. Cl.[7] ..... B24B 49/00

(52) U.S. Cl. ..... 451/5; 451/9; 451/41; 451/285; 451/287

(58) Field of Search ..... 451/9, 10, 11, 41, 451/285, 286, 287, 5, 413, 414

(56) References Cited

U.S. PATENT DOCUMENTS

| | | | | |
|---|---|---|---|---|
| 5,567,199 | A | 10/1996 | Huber et al. | |
| 5,816,895 | A | 10/1998 | Honda | |
| 6,206,754 | B1 * | 3/2001 | Moore | 451/8 |
| 6,472,325 | B2 * | 10/2002 | Hofmann et al. | 438/692 |
| 6,494,769 | B1 * | 12/2002 | Sinclair et al. | 451/288 |

* cited by examiner

*Primary Examiner*—Eileen P. Morgan
(74) *Attorney, Agent, or Firm*—Rabin & Berdo, P.C.

(57) ABSTRACT

A wafer grinder withholds a lateral force and adjusts a tilt of worktable with precision. The wafer grinder is used to grind a wafer; that is, the tilt angle of wafer can be adjusted so that wafer is ground with precision. The wafer grinder has a housing module, a rotary worktable module, air pressure spindle module and an adjustment module.

11 Claims, 7 Drawing Sheets

WAFER GRINDER

BACKGROUND OF THE INVENTION

1. Field of the Invention

The present invention relates to a wafer grinder, and in particular to a wafer grinder that withholds lateral force and accurately makes adjustment to a worktable.

2. Description of Related Art

As is widely known in semiconductor industries, how to improve a total thickness variation (TTV) of a wafer grinder is a current topic of interest. The related technique includes a feedback circuit and an improved mechanism suitable for implementation in wafer grinders with high precision. Thus, it meets requirement of wafer grinding in the modern era. Utility and cost-cutting of the wafer grinder are widely recognized.

Generally, the wafer grinder includes an air pressure worktable and an air pressure spindle and is used to machine or mill brittle material. A vacuum disk is made of porous ceramic and is positioned above the air pressure worktable. A plurality of air holes are positioned within the air pressure worktable and used as the air pressure spindle. When milling or machining wafers with diamond wheels, the spindles of the diamond wheels are bent by a reaction force and are tilted. In addition, temperature of the diamond wheels rises so that the position of the diamond wheels is not in alignment with the wafers.

In the prior art, U.S. Pat. No. 5,567,199 discloses a conventional wafer grinder. Referring to FIG. 1, it illustrates a schematic drawing of a conventional wafer grinder. A displacement meter 31*a* is positioned on a worktable 22*a* and is used to measure displacement of a piezoelectric actuator 3*a*. Then, the displacement meter 31*a* transmits measurement data to a central computing unit (CPU) 32*a*, and the piezoelectric actuator 3*a* adjusts its displacement in response to measurement data of the displacement meter 31*a*. Thus, a wafer 2*a* is held by a vacuum disk 21*a* and rotated in a certain rotational direction. The wafer 2*a* is ground by a grinding wheel 1*a* due to relative movement between the wafer 2*a* and the grinding wheel 1*a*. However, the piezoelectric actuator 3*a* is subjected to a lateral force during the grinding process, which has a significant bad impact on the precision of grinding. The '199 patent discloses two features. Firstly, a feedback system is additionally positioned at the displacement meter 31*a* and is used to measure the displacement of the piezoelectric actuator 3*a*. However, a measuring device and an object measured are not in the same geometrical position, so the measurement is prone to error. Secondly, the piezoelectric actuator 3*a* is used to adjust the worktable 22*a* and is positioned below the worktable 22*a*. Because the piezoelectric actuator 3*a* is subject to the weight of the worktable 22*a*, the piezoelectric actuator 3*a* is prone to damage.

Additionally, U.S. Pat. No. 5,816,895 is shown in FIG. 2. The conventional wafer grinder utilizes four piezoelectric actuators 3*b* to adjust a tilt angle of a worktable 22*b*. The four piezoelectric actuators 3*b* are positioned below the worktable 22*b* and separated by 90 degrees. Alternately, four piezoelectric actuators 12*b* are positioned at a spindle of a wafer grinder 1*b* to adjust the tilt of the spindle of the wafer grinder 1*b*. Further, three displacement meters 31*b* are arranged over the wafer (not numbered) and transmit a thickness of the wafer to a central computing unit (CPU) 32*b* during the grinding process. A piezoelectric device 34*b* is used to control the piezoelectric actuators 12*b* and 3*b* so that the wafer 2*b* is ground by the wafer grinder 1*b* because the worktable 22*b* is adjusted by the piezoelectric device 34*b*. However, because the piezoelectric actuator 3*a* is subject to the weight of the worktable 22*a*, it has a significant impact on the precision of the grinding process. The '985 patent discloses two features. Firstly, a feedback system is additionally positioned with the displacement meters 31*b* and is used to measure the thickness of the wafer 2*b*. Thus, a measuring device and an object measured are not in the same geometrical position, so the measurement is prone to error. Secondly, the piezoelectric actuator 3*b* is used to adjust the worktable 22*b* and is positioned below the worktable 22*b*. It is thus prone to damage.

As described in U.S. Pat. Nos. 5,567,199 and 5,816,895, the adjustment mechanism of the worktable is positioned below the worktable to support the weight of the worktable and has no pre-compression device. As described in the '199 patent, a detection system is positioned near the spindle of the grinding wheel and is prone to contamination by machine oil. According to the '199 patent, the detection system of the piezoelectric actuator is a strain gauge attached to the surface of the piezoelectric actuator. Because the strain gauge and the piezoelectric actuator are in the same position, the displacement is regarded as an input value.

FIG. 3A illustrates how a wafer 2*c* is ground by a grinding wheel 1*c*. The wafer 2*c* is ground by friction between the wafer 2*c* and the grinding wheel 1*c* during the grinding process. Further referring to FIG. 3B, the predetermined position 12*d* of the grinding wheel 1*c* does not coincide with the practical position 11*d* of the grinding wheel 1*c*. Thus, it renders non-uniform the thickness of the wafer 2*d*.

Thus, there is need to develop a mechanism for adjusting a machining angle of a wafer.

SUMMARY OF THE DISCLOSURE

It is an object of the present invention to provide a wafer grinder.

In order to accomplish one object of the present invention, the present invention provides a wafer grinder. The present invention utilizes a static air pressure spindle to absorb the lateral force, and a piezoelectric actuator is concentrically positioned with a displacement meter.

The present invention includes a housing module, a rotary worktable module, an air pressure spindle module and an adjustment module. The housing module is fixedly positioned on the wafer grinder. The rotary worktable module includes a worktable body and a spindle, which are rotatably positioned to the wafer grinder. The rotary worktable module also has a wafer holding sub-module. The air pressure spindle module is positioned on the wafer grinder and has an air channel. The air channel is used to direct air with certain pressure to the housing module and the rotary worktable module to act as an air cushion spindle to support the worktable body and the spindle. The adjustment module is positioned at the housing module and has a piezoelectric actuator and a displacement meter. The longitudinal rotation between the spindle and the worktable body has an air cushion to offset the lateral force during the grinding process.

BRIEF DESCRIPTION OF DRAWINGS

The present invention can be fully understood from the following detailed description and preferred embodiment with reference to the accompanying drawings in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
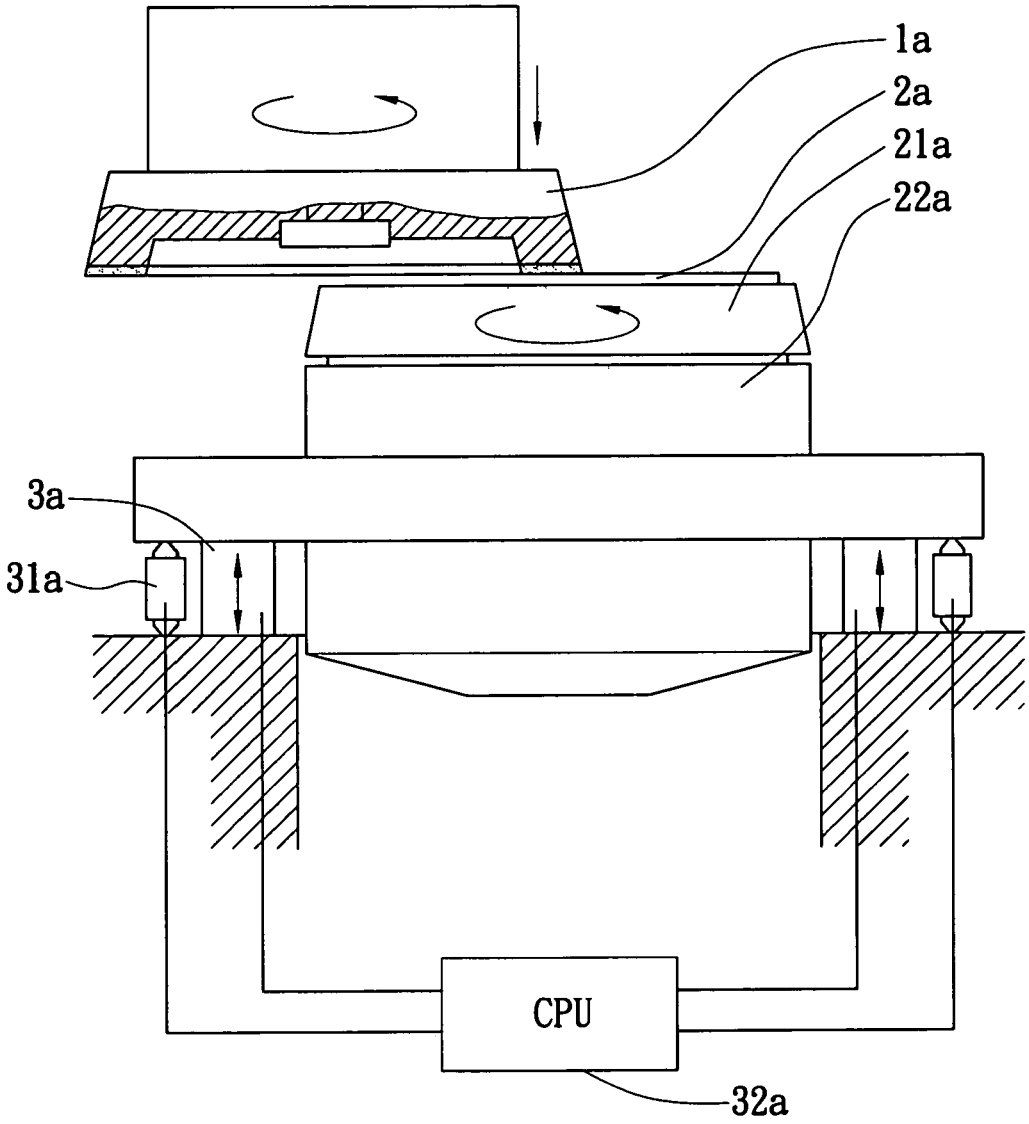
FIG. 1 PRIOR ART
FIG. 1 is a schematic drawing of a conventional wafer grinder.
Figure 2:
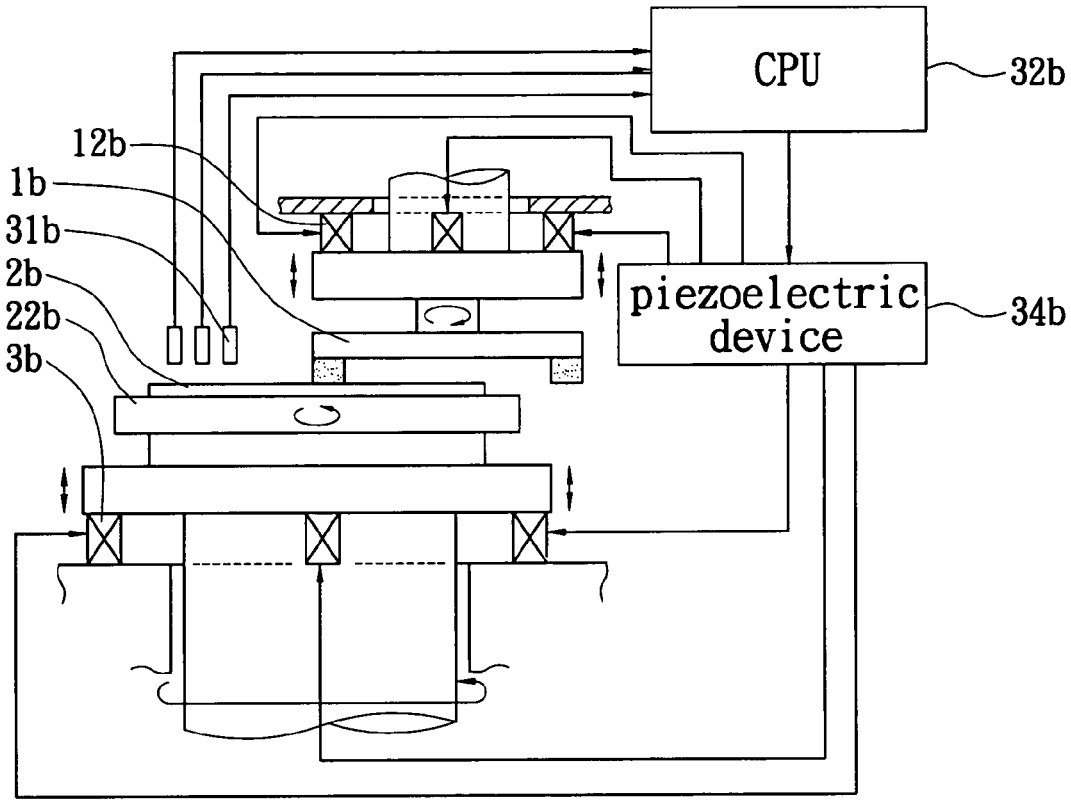
FIG. 2 PRIOR ART
FIG. 2 is another schematic drawing of a conventional wafer grinder.
Figure 3A:
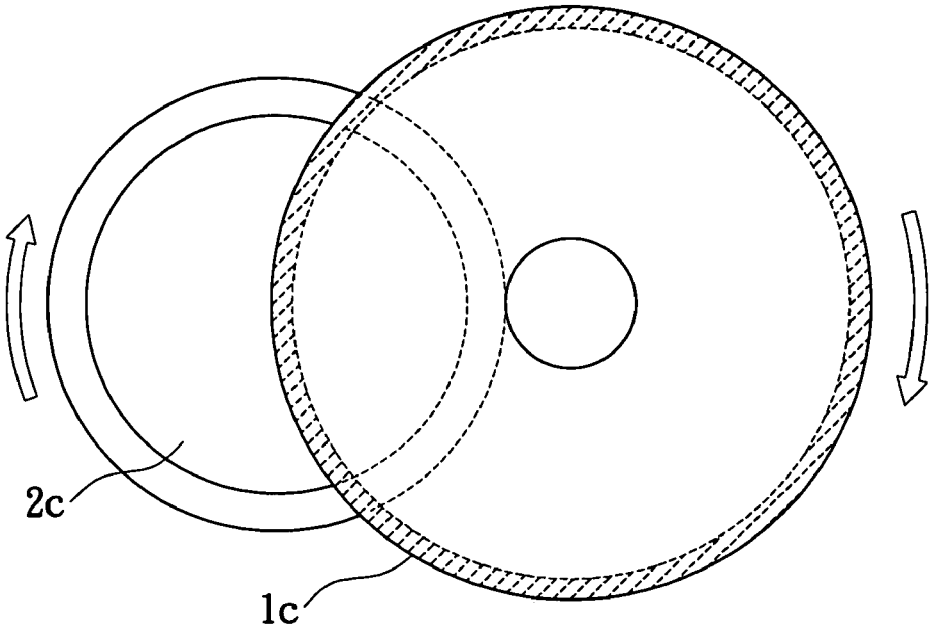
FIG. 3A PRIOR ART
FIG. 3A is a schematic drawing illustrating how a wafer is ground by a grinding wheel.
Figure 3B:
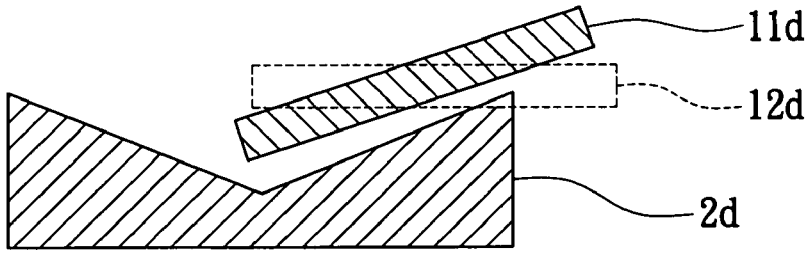
FIG. 3B PRIOR ART
FIG. 3B is another schematic drawing illustrating how a wafer is ground by a grinding wheel.
Figure 4:
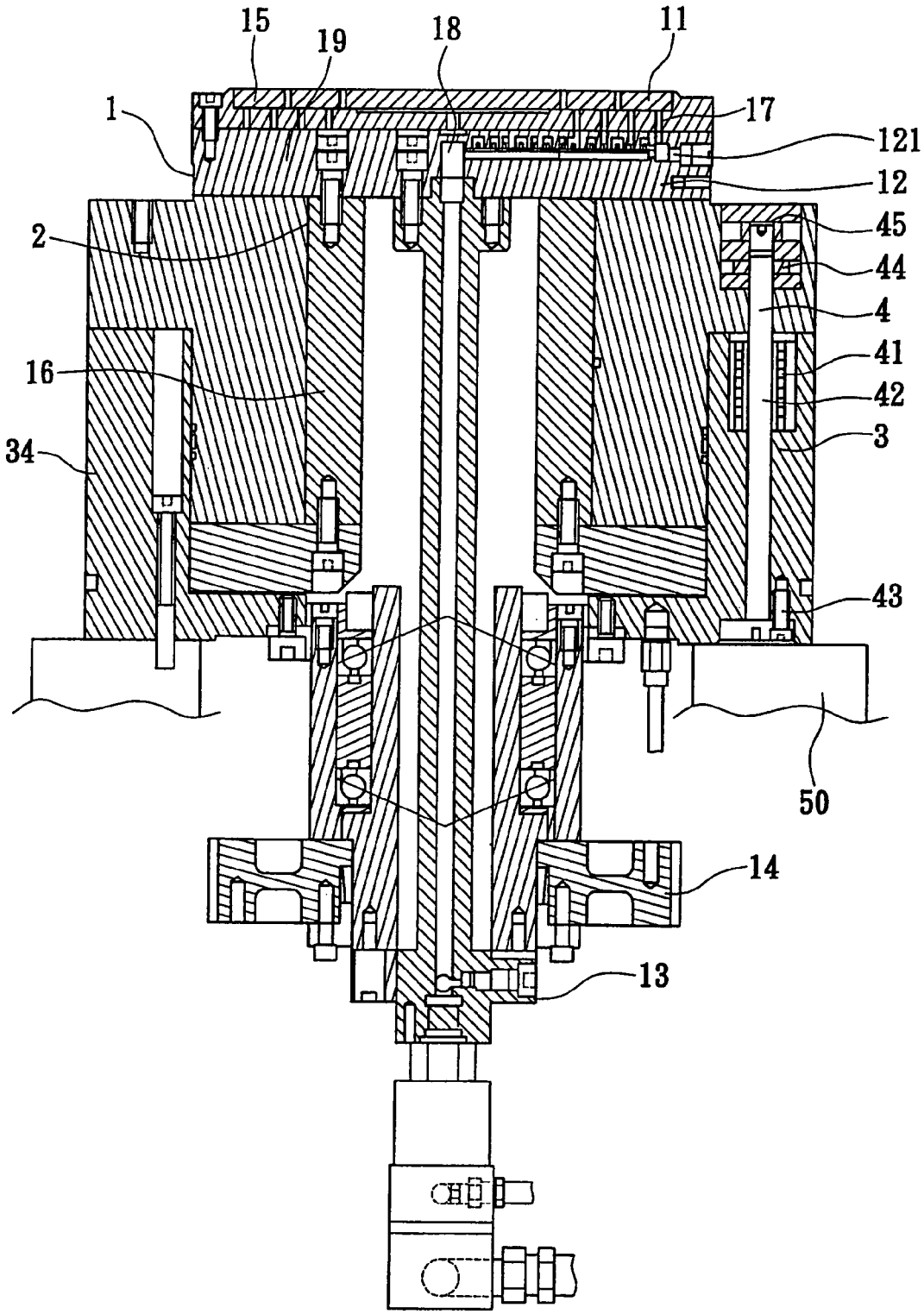
FIG. 4 is a cross-sectional view of a wafer grinder of the present invention.
Figure 5:
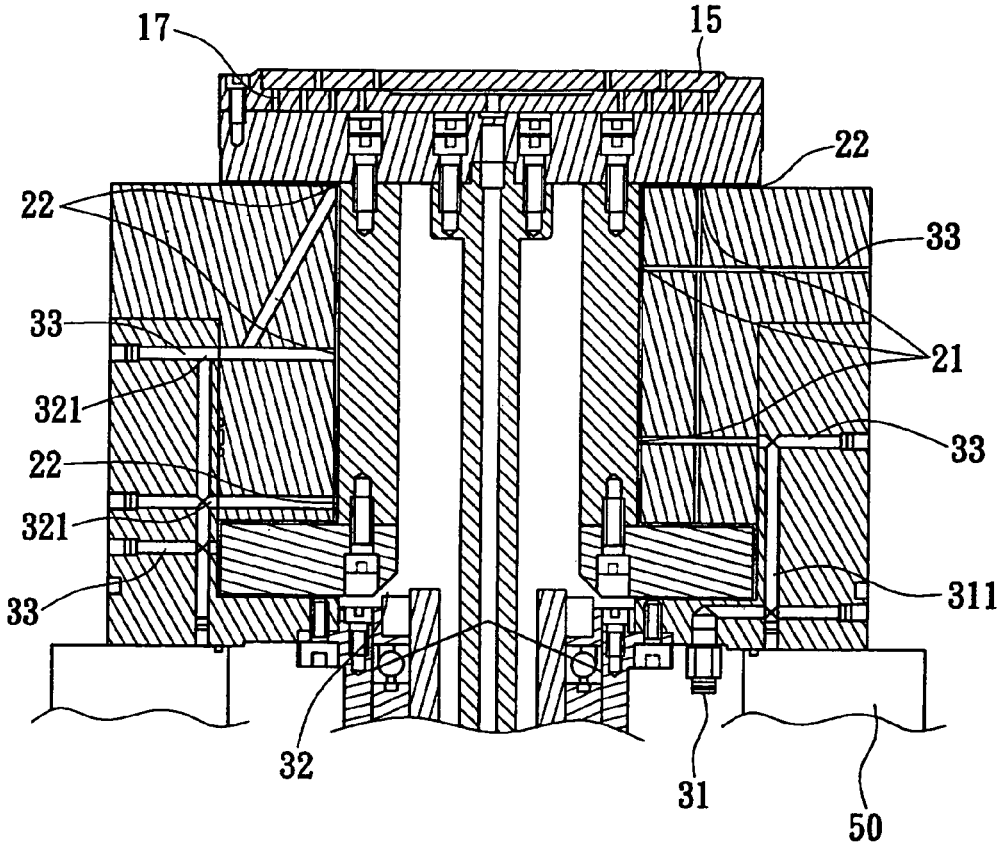
FIG. 5 is another cross-sectional view of a wafer grinder of the present invention.
Figure 6:
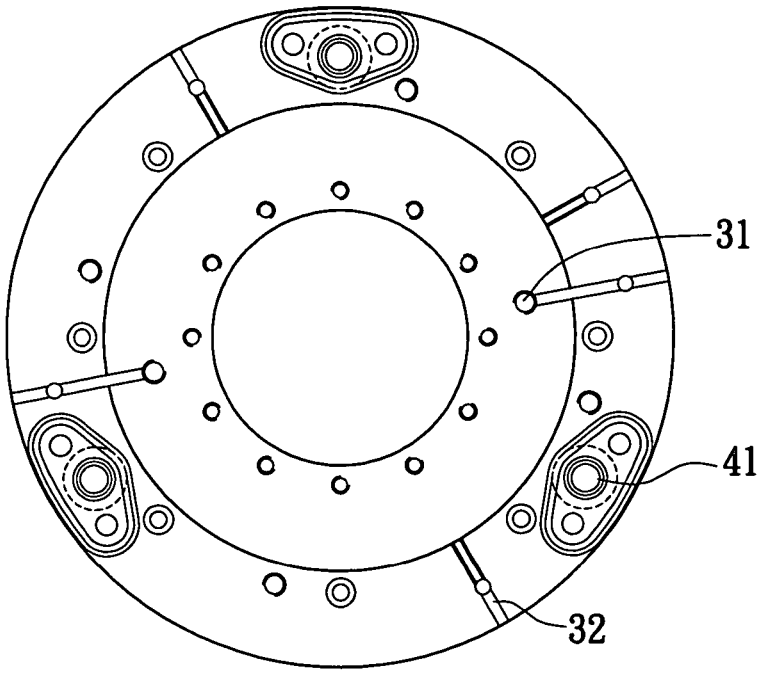
FIG. 6 is a top planar view of a wafer grinder of the present invention.
Figure 7:
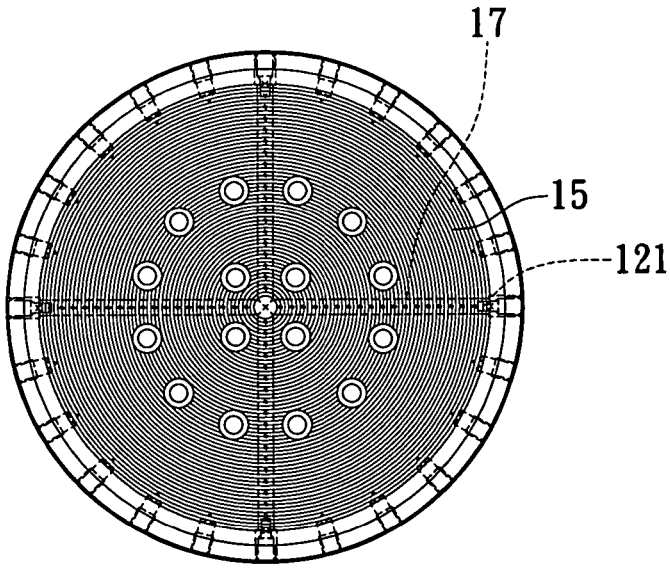
FIG. 7 is another top planar view of a wafer grinder of the present invention.
Figure 8:
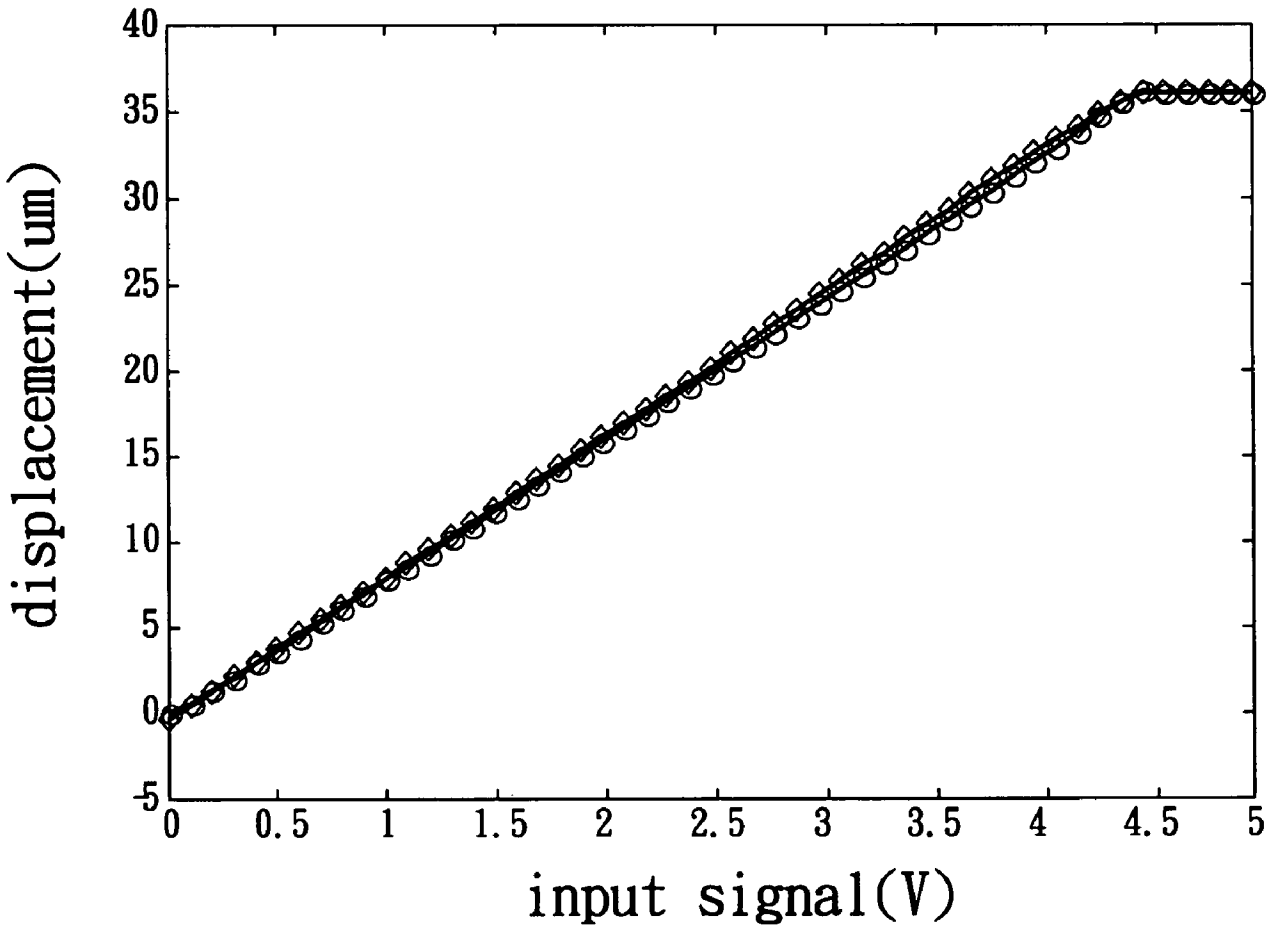
FIG. 8 is a chart illustrating a relationship between displacement of a piezoelectric actuator and input signals according to the present invention.

Referring to FIG. 4, a wafer grinder of the present invention includes a rotary worktable 1, an air pressure protection bearing 2, a housing 3 and an adjustment module 4. The rotary worktable 1 includes a spindle 16 positioned at a center of the air pressure protection bearing 2 and a housing 3. The rotary worktable 1 includes a rotary worktable body 19, which has a vacuum nozzle 17 and a pump hose 18. The adjustment module 4 is positioned at perimeter of the air pressure protection bearing 2 and the housing 3 and is equally separated by 120 degrees, as shown in FIG. 6. The rotary worktable 1 includes a vacuum disk 11 made of porous material 15. As shown in FIG. 4, a support plate 12 is defined below the vacuum disk 11. Further referring to FIG. 7, an adjusting screw 121 is provided in the support plate 12 so as to adjust the vacuum disk 11 to hold a wafer of 4 inches, 6 inches or 8 inches. The rotary worktable 1 also includes a coupling 13 made of rubber. The coupling 13 connects with a timing plate belt pulley 14, so motor power is delivered by the timing plate belt pulley 14. The air pressure protection bearing 2 includes an air inlet 21 and an air outlet 22, as shown in FIG. 5. An air inlet hose 311 and an air outlet hose 321 are used to deliver static pressure air to the air pressure protection bearing 2. As shown in FIG. 4, the adjustment module 4 includes a piezoelectric actuator 41 to adjust a tilt angle of the rotary worktable 1. A pre-compression bolt 42, a hexagonal socket screw 43, a disc spring 44 and a locking screw 45 generate a pre-compressive force on the piezoelectric actuator 41. The result is an improved rigidity of the rotary worktable 1. A displacement meter is positioned within the adjustment module 4 so as to measure the displacement of the rotary worktable 1. The displacement meter and the piezoelectric actuator 41 are placed in the same geometrical position. FIG. 8 illustrates a relationship between the displacement of the piezoelectric actuator 41 and corresponding input signal. Most of the relationship is linear. An auxiliary groove 33 is integrally formed with a holding body 34 to facilitate machining the airflow hose (the air inlet hose 311 and the air outlet hose 321).

As shown in FIG. 4, the wafer grinder according to present invention includes a housing module having a holding body 34 and being fixedly positioned on the wafer grinder. The rotary worktable module includes a worktable body 19 and spindle 16 that are rotatably positioned on the holding body 34 of wafer grinder. The rotary worktable module also has a wafer holding sub-module. The air pressure spindle module is positioned on the holding body 34 of the wafer grinder and has an air channel (the air inlet hose 311 and the air outlet hose 321). The air channel is used to direct air with a certain pressure to the housing module and the rotary worktable module to act as an air cushion spindle to support the worktable body 19 and the spindle 16. The adjustment module is positioned on the holding body 34 and has a piezoelectric actuator 41 and a displacement meter. The longitudinal rotation between the spindle 16 and the worktable body has an air padding to offset the lateral force during the grinding process.

The description of the present invention is as follows. The holding body 34 includes the auxiliary groove 33 to facilitate drilling of the airflow grooves. The base structure 50 of the wafer grinder is usually a conventional civil structure for setting up a machine to ensure stability. The wafer holding sub-module is provided on the worktable body 19 and also includes the vacuum nozzle 17 and the pump hose 18 so that a wafer is held steadily by a vacuum. In general, the spindle 16 is connected to the worktable body 19 to rotate the worktable body 19 so that it is more convenient for the configuration of all components. The rotary worktable module further includes an adjustment sub-module positioned within the worktable body 19. The adjustment sub-module includes the adjusting screw 121 to block longitudinally the vacuum nozzle 17 to adjust to wafers of different sizes. To make measurements accurate, the piezoelectric actuator 41 and the displacement meter are in the same geometrical position. To make displacement uniform, three pairs of piezoelectric actuator 41 and displacement meter are positioned at the bottom of the worktable body 19 by the same separation to adjust a tilt angle of the worktable body 19. To make movement accurate, the spindle 16 is driven by a flexible belt-like structure to prevent shock from being transmitted to the spindle 16. To make design of the grinder easy, the spindle 16 further includes the coupling 13 and the timing plate belt pulley 14. The coupling 13 connects with a timing plate belt pulley 14, so motor power is delivered by the timing plate belt pulley 14. To keep rigidity of the wafer grinder, the disc spring 44 generates a pre-compressive force on the piezoelectric actuator 41.

The advantages of the present invention can be summarized as follows:

1. The present invention provides an air pressure worktable that can adjust a machining angle with greater precision. In particular, the spindle 16 is subjected to a lateral cutting force so that cutting precision and lifetime of grinder can be extended. The air pressure protection bearing 2 helps to rotate the rotary worktable 1 with precision. The air pressure protection bearing 2 experiences the displacement of the piezoelectric actuator 41 and generates the tilt angle.

2. The present invention provides the capability of measuring tilt of a rotary worktable 1 because the piezoelectric actuator 41 and a displacement meter are in the same geometrical position. The disc spring 44 and a locking screw 45 produce a pre-compressive force on the piezoelectric actuator 41 so that rigidity of the rotary worktable 1 is increased and displacement is controlled with much higher precision.

3. The present invention provides a rotary worktable 1 to hold wafers of 4, 6 or 8 inches. Four adjusting screws 121 are used to adjust a groove within the support plate 12 and make changes to the holding surface.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A wafer grinder, comprising:

a base structure:

a housing module, including a holding body, the housing module being fixedly positioned on the base structure of the wafer grinder;

a rotary worktable module, including a worktable body and a spindle rotatably positioned on the wafer grinder, wherein the rotary worktable module includes a wafer holding sub-module;

an air pressure protection bearing module, positioned on the holding body and including an air channel to direct an airflow with a certain pressure to the housing module and the rotary worktable module to act as an air cushion spindle to support the worktable body and the spindle; and an adjustment module, positioned on the holding body and including a piezoelectric actuator and a displacement meter;

wherein a longitudinal rotation between the spindle and the worktable body includes an air padding to offset a lateral force during a grinding process.

2. The wafer grinder as claimed in claim 1, wherein the holding body includes an auxiliary groove to facilitate machining base structure an airflow hose.

3. The wafer grinder as claimed in claim 1, wherein the base structure of the wafer grinder is a conventional civil structure for setting up a machine.

4. The wafer grinder as claimed in claim 2, wherein the wafer holding sub-module is positioned on the worktable body of the rotary worktable module and includes a vacuum nozzle and a pump hose.

5. The wafer grinder as claimed in claim 1, wherein the spindle is connected to the worktable body to rotate the worktable body.

6. The wafer grinder as claimed in claim 4, wherein the rotary worktable module further includes an adjustment sub-module positioned within the worktable body, and the adjustment sub-module includes an adjusting screw to block radially the vacuum nozzle to adjust to wafers with different sizes.

7. The wafer grinder as claimed in claim 1, wherein the displacement meter and the piezoelectric actuator are placed in a same concentric geometrical position.

8. The wafer grinder as claimed in claim 7, wherein three sets of piezoelectric actuator with the displacement meter are positioned at a bottom of the worktable body by a uniform angle separation to adjust a tilt angle of the worktable body.

9. The wafer grinder as claimed in claim 1, wherein the spindle is driven by a flexible, belt structure to prevent a shock of rotation from being transmitted to the spindle.

10. The wafer grinder as claimed in claim 9, wherein the spindle further includes a rubber coupling and a timing plate belt pulley so that the rubber coupling connects with the timing plate belt pulley and motor power is transmitted to input timing plate belt pulley.

11. The wafer grinder as claimed in claim 1, further comprising the disc spring generates a pre-compressive force on the piezoelectric actuator.

* * * * *